US005677696A

United States Patent [19]

Silverstein et al.

[11] Patent Number: 5,677,696

[45] Date of Patent: Oct. 14, 1997

[54] METHOD AND APPARATUS FOR REMOTELY CALIBRATING A PHASED ARRAY SYSTEM USED FOR SATELLITE COMMUNICATION USING A UNITARY TRANSFORM ENCODER

[75] Inventors: Seth David Silverstein; Robert Leland Nevin, both of Schenectady; William Ernest Engeler, Scotia, all of N.Y.

[73] Assignee: General Electric Company, Schenectady, N.Y.

[21] Appl. No.: 499,796

[22] Filed: Jul. 7, 1995

[51] Int. Cl.[6] ..... H01Q 3/22

[52] U.S. Cl. ..... 342/360; 342/375; 342/174; 342/165

[58] Field of Search ..... 342/165, 173, 342/174, 194, 375, 442, 360

[56] References Cited

U.S. PATENT DOCUMENTS

| | | | |
|---|---|---|---|
| 4,504,860 | 3/1985 | Nicol et al. | 358/133 |
| 5,081,460 | 1/1992 | Liu . | |
| 5,175,556 | 12/1992 | Berkowitz . | |
| 5,493,710 | 2/1996 | Takahara et al. | 455/192.2 |

OTHER PUBLICATIONS

"Orthogonal Transformations" by H. Andrews and K. Caspari, Computer Techniques in Image Processing, 1970, pp. 73–103.

"Two–Dim ensional Discrete Fourier Transform" by V. Oppenheim and R.W. Schafer, Digital Signal Processing, pp. 115–121.

"DSCS III Receive Multiple Beam Antenna Performance Improvement", Y.P. Loh, R.T. Goalwin, National Telesystems Conference, Mar. 26 & 27, 1991, World Congress Center, Atlanta, Georgia.

"On–Orbit Performance Tests of DSCS III Receive MBA", R.T. Goalwin, R.A. Williams, L.D. Graham, Y.P. Loh, Mar. 19, 1990, pp. 1–4.

"Performance Limitations and Improvement Scheme for DSCS III Receive Multiple Beam Antenna" by Y.P. Loh, Mar. 7, 1990, pp. 1–4.

"Hadamard Transform Imaging Coding" by W.K. Pratt, J. Kane, H.C. Andrews, Proceedings of the IEEE, vol. 57, No. 1, Jan. 1969, pp. 58–68.

"Far Fiaeld Alignment and Testing of Passive Phased Array Antennas" by H.E. Schrank, Westinghouse Electronic Corp. Baltimore, Maryland, pp. 1–9.

"Computer–Aided Fault Determination for an Advanced Phased Array Antenna" by D.K. Alexander, R.P. Gray, Jr., Sep. 26–28, 1979 for 1979 Antenna Applications Symposium, Urbana, Ill. pp. 1–13.

(List continued on next page.)

*Primary Examiner*—Thomas H. Tarcza
*Assistant Examiner*—Dao L. Phan
*Attorney, Agent, or Firm*—Marvin Snyder

[57] ABSTRACT

A method and apparatus for remotely calibrating a system having a plurality of N elements, such as a phased array system, is provided. The method includes generating coherent signals, such as a calibration signal and a reference signal having a predetermined spectral relationship between one another. The calibration signal which is applied to each respective one of the plurality of N elements can be orthogonally encoded using a unitary transform encoder that uses a predetermined transform matrix, such as a Hadamard transform matrix or a two-dimensional discrete Fourier transform matrix, to generate a set of orthogonally encoded signals. The set of orthogonally encoded signals and the reference signal are transmitted to a remote location. The transmitted set of orthogonally encoded signals is coherently detected at the remote location. The coherently detected set of orthogonally encoded signals is then decoded using the inverse of the predetermined encoding matrix to generate a set of decoded signals. The set of decoded signals is then processed for generating calibration data for each element of the phased array system.

24 Claims, 8 Drawing Sheets

OTHER PUBLICATIONS

"Phased Array Alignment and Calibration Techniques", James M. Howell, Workshop on Testing Phased Arrays and Diagnostics, Jun. 30, 1989.

"A Large Deployable Active Phased Array Antenna for Satellite Use", T. Katagi, Y. Konishi, Y. Tamai, Y. Iida, Mitsubishi Electric Corp., Proceedings of 15th AIAA International Communications Satellite Systems. Conf., San Diego, CA, Feb. 28–Mar. 3, 1994, pp. 1075–1083.

"A Built–In Performance–Monitoring/Fault Isolation and Correction (PM/FIC) System for Active Phased–Array Antennas", M. Lee, R.–S.–C. Liu, Hughes Aircraft Company, IEEE Trans. on Antennas and Propagation, vol. 41–11, ov. 1993, pp. 1530–1540.

U.S. patent application entitled "A Method and Apparatus For Remotely Calibrating A Phased Array System Used for Satellite Communication" (Attorney Docket RD–23598) Seth D. Silverstein et al.

METHOD AND APPARATUS FOR REMOTELY CALIBRATING A PHASED ARRAY SYSTEM USED FOR SATELLITE COMMUNICATION USING A UNITARY TRANSFORM ENCODER

BACKGROUND OF THE INVENTION

Active phased array systems or smart antenna systems have the capability for performing programmable changes in the complex gain (amplitude and phase) of the elemental signals that are transmitted and/or received by each respective element of the phased array system to accommodate different beam-forming scenarios. Communications satellites equipped with phased array systems are desirable since satellites so equipped have an intrinsic performance advantage over satellites with conventional reflector antennas. For example, a communications satellite with a phased array system can offer the following advantages: reconfigurable beam patterns ranging from broad-uniform continental coverage down to narrow spot beam patterns with 3 dB widths of about 1°; flexibility in varying the level of effective isotropic radiated power (EIRP) in multiple communication channels; and means for providing graceful system performance degradation to compensate for component failures. As conditions for the phased array system in the satellite can change in an unpredictable manner, regularly scheduled calibration for characteristics of the system, such as phase and amplitude characteristics, is generally required to assure optimal system performance.

In order to obtain meaningful estimates of the respective complex gains for the elemental signals respectively formed in each element of the phased array system, the calibration process must be performed in a time window that is sufficiently short so that the complex gains for the respective elemental signals transmitted from each element are substantially quasi-stationary. For a typical geostationary satellite application, the relevant time windows are dominated by two temporally variable effects: changes in the transmitted elemental signals due to variable atmospheric conditions encountered when such signals propagate toward a suitable control station located on Earth; and changes in the relative phase of the transmitted elemental signals due to thermally induced effects in the satellite, such as phase offsets in the respective circuit components for each respective element of the phased array system, and physical warpage of a panel structure employed for supporting the phased array. The thermally induced effects are caused primarily by diurnal variations of the solar irradiance on the phased array panel.

Calibration techniques proposed heretofore are essentially variations on the theme of individually measuring, one at a time, the respective complex gain of each single element (SE) of the phased array system while all the other elements of the phased array system are turned off. Although these calibration techniques (herein referred as SE calibration techniques) are conceptually simple, these SE calibration techniques unfortunately have some fundamental problems that make their usefulness questionable for meeting the calibration requirements of typical phased array systems for communications satellites. One problem is the difficulty of implementing a multipole microwave switching device coupled at the front end of the respective electrical paths for each elemental signal so as to direct or route suitable test signals to any single element undergoing calibration. This multipole switching device is typically necessary in the SE calibration techniques to measure the complex gain for the elemental signal respectively formed in any individual element undergoing calibration at any given time. Another problem of the SE calibration techniques is their relatively low signal-to-noise ratio (SNR). This effectively translates into relatively long measurement integration times. At practical satellite power levels, the integration times required to extract the calibration measurements for the SE calibration techniques are often too long to satisfy the quasi-stationarity time window criteria described above. In principle, one could increase the effective SNR of the SE process by increasing the power of the calibration signals transmitted from each element. However, as each element of the phased array system is usually designed to operate at near maximum power, as dictated by the power-handling capacity and linearity constraints for the circuit components in each element, it follows that arbitrary additional increases in power levels are typically not feasible. Thus it is desirable to provide a calibration method that allows for overcoming the problems associated with SE calibration techniques.

SUMMARY OF THE INVENTION

Generally speaking, the present invention fulfills the foregoing needs by providing a method and apparatus for remotely calibrating a system having a plurality of N elements, N being a positive integer number. The method includes generating coherent signals, such as a calibration signal and a reference signal having a predetermined spectral relationship between one another. The calibration signal which is applied to each respective one of the plurality of N elements can be orthogonally encoded using a unitary transform encoder that uses a predetermined transform matrix, such as a Hadamard transform matrix or a two-dimensional discrete Fourier transform matrix, to generate a set of orthogonally encoded signals. The set of encoded signals and the reference signal are transmitted to a remote location. The transmitted set of encoded signals is coherently detected at the remote location. The coherently detected set of encoded signals is then decoded using the inverse of the predetermined transform matrix to generate a set of decoded signals. The set of decoded signals is then processed for generating calibration dam for each element of the system.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following detailed description in conjunction with the accompanying drawings in which like numerals represent like parts throughout the drawings, and in which:

DETAILED DESCRIPTION OF THE INVENTION

Figure 1:
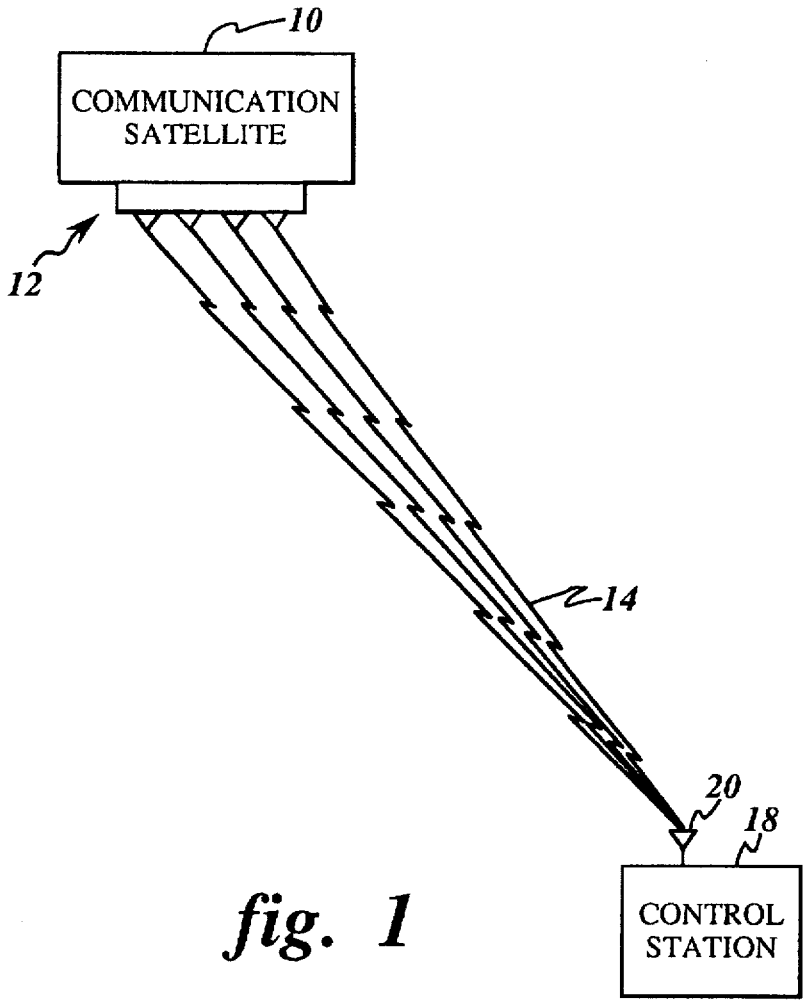
FIG. 1 is a simplified block diagram representation of a communications satellite using a phased array system that can be remotely calibrated in accordance with the present invention from a remote control station.

FIG. 1 illustrates a communications satellite 10 that incorporates a phased array system 12 for transmitting and/or receiving radio frequency (RF) signals 14. If, for example, phased array system 12 is used in a transmitting mode, then RF signals 14 can be received at a remote control station 18, such as an earth-based control station, through a receiving antenna 20. As will be appreciated by those skilled in the art, a phased array system operates on the principle that the phase of the RF signals emitted from the elements of the array can be selectively adjusted to provide a desired interference pattern at locations that are spatially remote from each element of the phased array. Consider an RF transmission from an N-element phased array system at wavelength λ. By way of example, choose a coordinate system with its origin at the center of the phased array. The signals $A(\vec{R}_i)$, received at spatial points $\vec{R}_i$, are the interference sum of N elemental signals, $$A(\vec{R}_i) = K_i \sum_{n=1}^{N} a(n)s(n, \vec{R}_i), \tag{1}$$

having waveforms $s(n,\vec{R}_i)$, such that $$s(n, \vec{R}_i) \propto \frac{e^{j2\pi|\vec{R}_i-\vec{r}_n|/\lambda}}{|\vec{R}_i-\vec{r}_n|} \xrightarrow{\text{far field}} \frac{e^{j2\pi|\vec{R}_i|/\lambda}}{|\vec{R}_i|} e^{-j2\pi\vec{r}_n\cdot\vec{R}_i/(\lambda|\vec{R}_i|)}. \tag{2}$$

Figure 2:
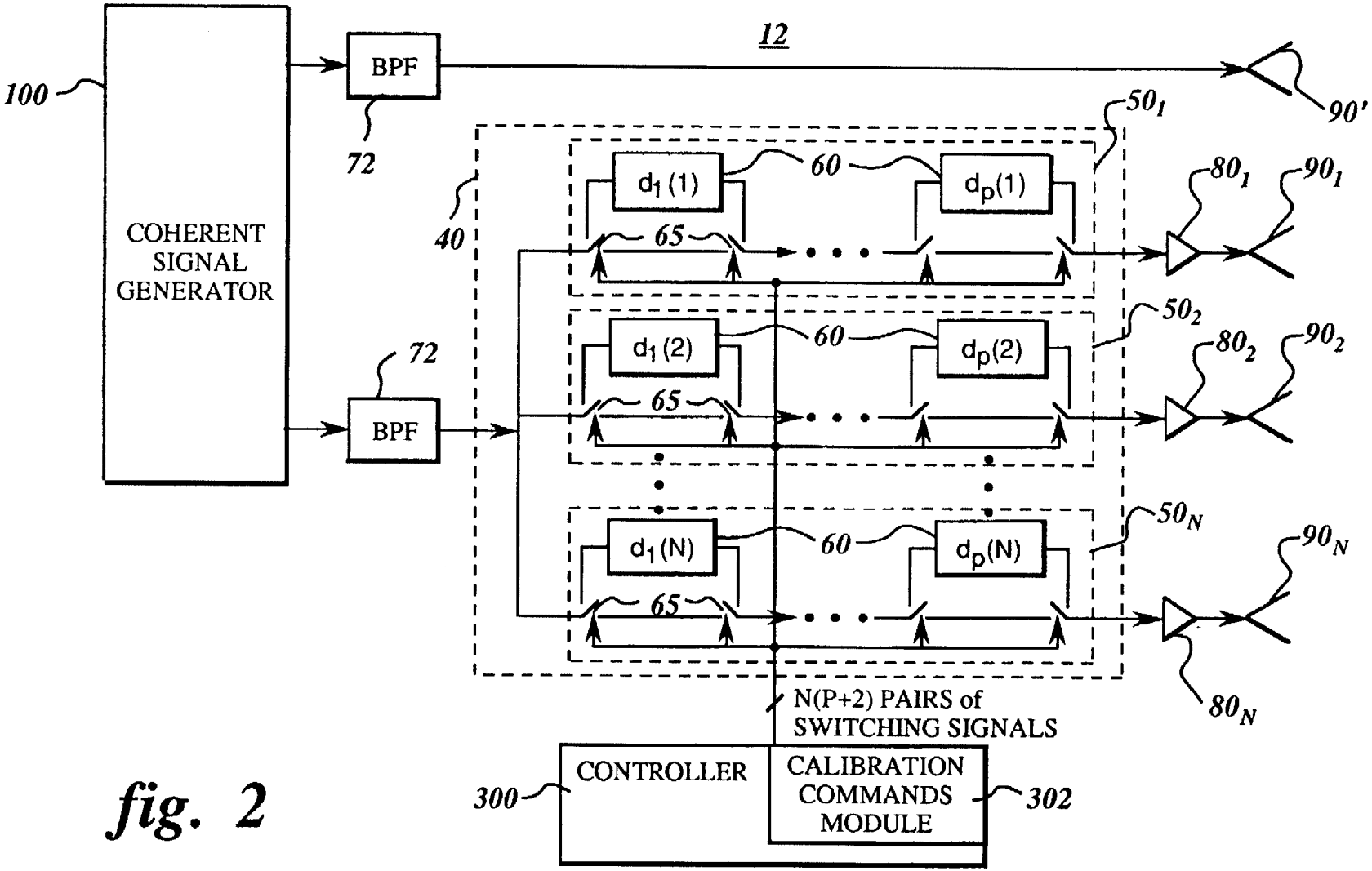
FIG. 2 is a block diagram representation showing an exemplary architecture for the phased array system of FIG. 1, and including a coherent signal generator and a controller for controllably switching respective delay circuits in each element of the phased array system in accordance with one preferred embodiment, as claimed in U.S. patent application Ser. No. 08/499,528, filed Jul. 7, 1995, now U.S. Pat. No. 5,572,219, issued Nov. 5, 1996.

The relative values of the set of coefficients, {a(n)}, give the relative complex gains associated with respective circuit components, such as phase shifters 50 (FIG. 2) and power amplifiers 80 (FIG. 2), for each element of the phased array. It can be shown that information merely obtained by spatially sampling any interference pattern transmitted and/or received by the phased array (but not encoded in accordance with the present invention) cannot easily extract phase offsets due to the relative positioning of the elemental horns of the phased array, such as transmitting horns 90 (FIG. 2). In principle, the value for each coefficient a(n) could be determined by measuring or sampling the amplitude and phase of the interference pattern at N distinct spatial sampling locations $\{\vec{R}_i\}$; i=1, 2, . . . , N, that are specifically selected to provide N linearly independent simultaneous equations. In practice this procedure would be very difficult to implement as N values of three different parameters would have to be known to compute a solution. The three different parameters include the spatial sampling locations $\{\vec{R}_i\}$, the elemental transmitting horn positions $\vec{r}_n$, and the relative values of the different propagation constants $K_i$.

In contrast to the above-described spatial sampling calibration technique, coherent signal encoding of the elemental signals provides a dramatic simplification as the encoded signals, which enable to form predetermined time multiplexed beam patterns, can be received at a single receiver point situated along a reference direction $\vec{R}_0$. Further, as there is only one propagation constant $K_0$, its value need not be known to determine the respective relative values of each complex gain. Also, in the far field, the parameters of interest can be obtained without knowledge of the distance to the single receiver point. It is assumed that the projection angle of reference direction $\vec{R}_0$ onto the uniform phase plane of the array is known to a precision commensurate with the desired calibration accuracy. As will be appreciated by those skilled in the art, the projection angle can be measured using readily available attitude measurements from conventional celestial body sensors, such as Earth, Moon and Sun sensors.

In the far field, the received signal of any mth coherently encoded transmission is of the form, $$A(m, \vec{R}_0) = K_0 \frac{e^{j2\pi|\vec{R}_0|/\lambda}}{|\vec{R}_0|} \sum_{n=1}^{N} t(m, n)a(n)e^{-j2\pi\vec{r}_n\cdot\vec{R}_0/(\lambda|\vec{R}_0|)}, \tag{3}$$

If t(m,n) represents the coefficients of a predetermined invertible, encoding matrix T, such as a unitary transform matrix, then the respective relative values of the product $\{a(n)e^{-j2\pi\vec{r}_n\cdot\vec{R}_0/(\lambda|\vec{R}_0|)}\}$ can be obtained directly from the inversion of matrix T which enables for solving a system of N linearly independent simultaneous equations. In general, the inverse of a unitary matrix U is equal to the Hermitian conjugate U* of the matrix U and thus $U^{-1} \equiv U^*$. As will be appreciated by those skilled in the art, the rows and columns of a unitary matrix, such as matrix U, form a complete orthonormal set of basis vectors that span the vector space upon which matrix U is defined. In general, orthogonal transforms are formally defined as the subset of unitary transformations defined on real vector spaces. Orthogonal transforms have been used extensively in imaging applications; see, for example, technical paper by W. K. Pratt, J. Kane, and H. C. Andrews, "Hadamard Transform Image Coding", Proc. IEEE 57, No. 1, at 58–68, (January 1969). As used herein the matrix T differs from its associated unitary matrix by a normalization factor $\sqrt{N}$. Accordingly, T is referred as a renormalized unitary matrix, $$T \equiv \sqrt{N}T \Rightarrow T^{-1} = 1/N\,T^*. \tag{4}$$

By way of example and not of limitation, it can be shown that a minimum variance encoding scheme can be achieved when using a renormalized unitary transform matrix where each matrix element has unit magnitude, i.e., |t(m,n)|=1. Some notable examples of equal magnitude renormalized unitary transform matrices are the classes of two-dimensional (2D) discrete Fourier transforms (DFT) and Hadamard transform matrices.

FIG. 2 shows a simplified schematic of an exemplary analog architecture for an N-element phased array system 12. It will be appreciated that the present invention need not be limited to analog architectures being that digital beam-forming architectures can readily benefit from the teachings of the present invention. It will be further appreciated that the present invention need not be limited to a phased array system being that any system that employs coherent signals, such as coherent electromagnetic signals employed in radar, lidar, communications systems and the like; or coherent sound signals employed in sonar, ultrasound systems and the like, can readily benefit from the teachings of the present invention.

Phased array system 12 includes a beam-forming matrix 40 made up of N phase shifters $\mathbf{50}_1$–$\mathbf{50}_N$ each having a p-bit beam-forming capability. Each respective phase shifter for each element is made up of p independent delay circuits 60 that, by way of suitable switches 65, can be selectively switched or actuated into the electrical path for each elemental signal to provide $2^p$ quantized phase levels corresponding to phase shifts of $2\pi m/2^p$ for m=0, 1, . . . , $2^p-1$. FIG. 2 further shows a coherent signal generator 100 that supplies a reference tone or signal having a predetermined spectral relationship with respect to a calibration signal applied to each element of the phased array. For example, the reference signal can be offset in frequency by a predetermined factor from the calibration signal. The reference signal and the calibration signal each passes through respective bandpass filters 72 having a predetermined passband substantially centered about the respective frequencies for the reference signal and the calibration signal. Although in FIG. 2 coherent signal generator 100 is shown as supplying one reference signal, it will be appreciated that additional reference signals, if desired, could be readily obtained from coherent signal generator 100.

As shown in FIG. 2, each phased array element further includes a respective power amplifier 80 and a respective horn 90. Although FIG. 2 shows that the reference signal is transmitted from a separate horn 90', the reference signal can, with equivalent results, be transmitted from any of the phased array elements as long as the reference signal is injected into the electrical path after any of the phase shifters $\mathbf{50}_1$–$\mathbf{50}_N$ so that the reference signal is unaffected by any encoding procedures performed by the phase shifters. FIG. 2 shows a controller 300 which, during normal operation of the system, can issue switching commands for forming any desired beam patterns.

In accordance with one preferred embodiment, controller 300 further includes a calibration commands module 302 for issuing first and second sets of switching signals that allow the delay circuits 60 for encoding corresponding first and second sets of signals being transmitted by the N elements of the phased array system to a remote location, such as control station 18 (FIG. 1 ).

As suggested above, the controlled switching, i.e., the encoding, is dictated by the matrix elements or entries of a predetermined invertible, binary matrix. In particular, a class of binary orthogonal matrices, such as Hadamard matrices, is optimal in the sense of providing minimal statistical variance for the estimated calibration parameters. The encoding matrix can be chosen to have a size N×N if N is an even number for which a Hadamard matrix can be constructed. If a Hadamard matrix of order N cannot be constructed, then the next higher order Hadamard construction can be conveniently used for the encoding. For example, the next higher order can be conveniently chosen as K=N+Q where Q is a positive integer number representing extra transmissions corresponding to non-existing elements and thus such extra transmissions are effectively treated as if they were made up of zero value signals. It will be appreciated by those skilled in the art that this matrix construction technique is analogous to "zero-filling" techniques used in a Fast Fourier transform, for example. Henceforth in our discussion for the sake of simplicity and not by way of limitation we will only consider Hadamard matrices, represented by H for the controlled switching (CS) procedure. It will be shown that upon performing suitable coherent detection and decoding at the remote location, the first and second sets of orthogonally encoded signals allow for determining calibration data indicative of any changes in the respective complex gains of the delay circuits, and including the respective signals {s(n) for n=1, 2, . . . , N} associated with each of the phased array elements when no delay circuit is switched-in, i.e., each signal associated with a respective undelayed or "straight-through" electrical path that includes the respective power amplifier and horn but does not include any delay circuit in any respective phased array element.

Figure 3A:
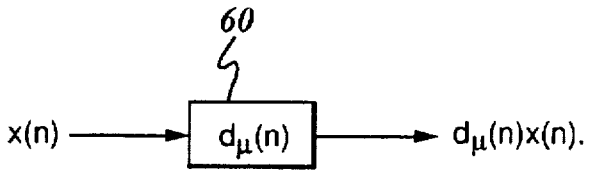
FIGS. 3*a* and 3*b* illustrate, respectively, gain characteristics for a single delay circuit being switched-in, and for multiple (two) delay circuits being switched-in in any given one of the elements of the phased array system of FIG. 2.
Figure 3B:
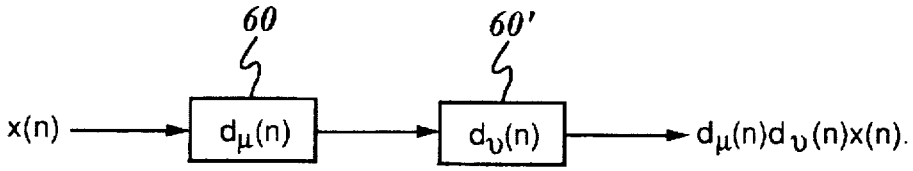

For an analog embodiment, it is assumed that the power levels for the calibration signal are low enough so that the phase shifters can be treated as linear microwave devices. For example, the effect of switching-in or actuating a single delay circuit 60, such as the μth delay circuit in any nth phase shifter with a complex gain dμ(n) simply imposes a complex gain as shown in FIG. 3*a* to an input signal x(n). The effect of switching-in or actuating multiple delay circuits 60 and 60' simply generates the product of the respective complex gains for the multiple circuits switched-in. For example, as shown in FIG. 3*b*, if the υth delay circuit for the nth phase shifter with a complex gain $d_\nu(n)$ is switched-in together with the μth delay circuit, then the complex gain for the input signal x(n) will be as shown in FIG. 3*b*.

Figure 4:
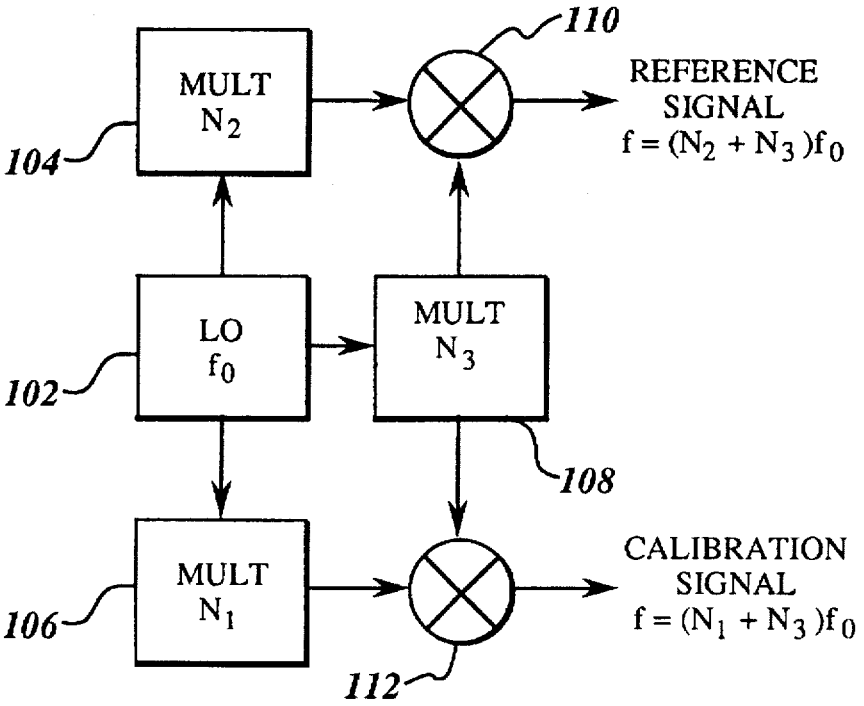
FIG. 4 shows further details about the coherent signal generator of FIG. 2.

FIG. 4 shows a simplified schematic for coherent signal generator 100 used for generating coherent signals, such as the calibration signal and the reference signal. As used herein the expression coherent signals refers to signals having a substantially constant relative phase relation between one another. As shown in FIG. 4, a local oscillator 102 supplies an oscillator output signal having a predetermined frequency $f_0$ to respective frequency multipliers 104, 106 and 108 each respectively multiplying the frequency of the oscillator output signal by a respective multiplying factor such as $N_1$, $N_2$ and $N_3$, respectively. As shown in FIG. 4, the respective output signals of multipliers 108 and 104 is mixed in a first mixer 110 to supply a first mixer output signal having a frequency $f=(N_1+N_3)f_0$. Similarly, the respective output signals of multipliers 106 and 108 are mixed in a second mixer 112 to supply a second mixer output signal having a frequency $f=(N_f+N_3)f_0$. By way of example, the first mixer output signal can constitute the reference signal and the second mixer output signal can constitute the calibrated signal applied to each element of the phased array system.

Figure 5:
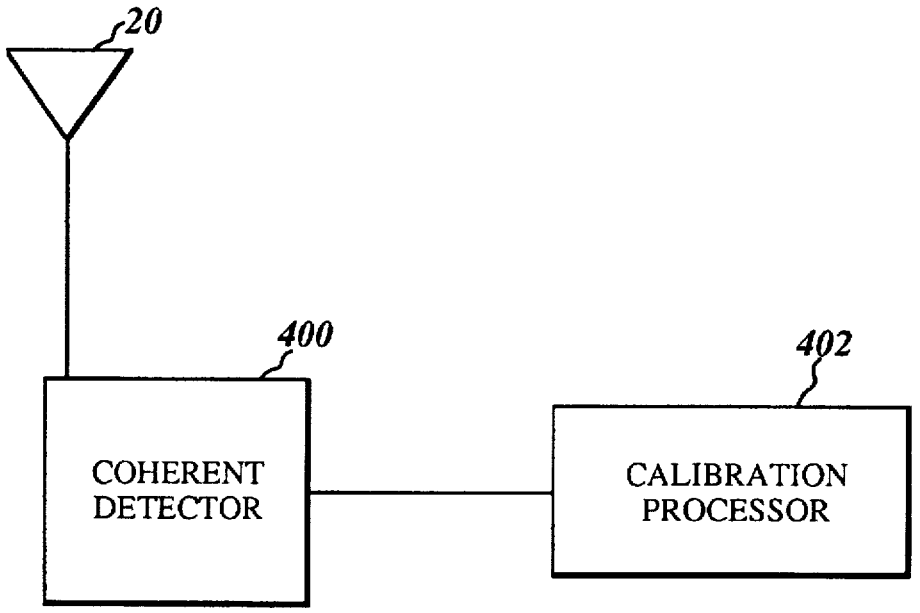
FIG. 5 is a simplified block diagram for a coherent detector and a calibration processor situated at the remote control station of FIG. 1.

FIG. 5 shows a simplified block diagram for a coherent detector 400 and a calibration processor 402 which can be situated at control station 18 (FIG. 1) for detecting and decoding, respectively, any sequences of encoded coherent signals being transmitted from the phased array system for determining calibration data which can then be conveniently "uplinked" to the satellite to compensate for changes in the various components which make up each respective element of the phased array system, such as power amplifiers, horns, and phase shifters.

Figure 6:
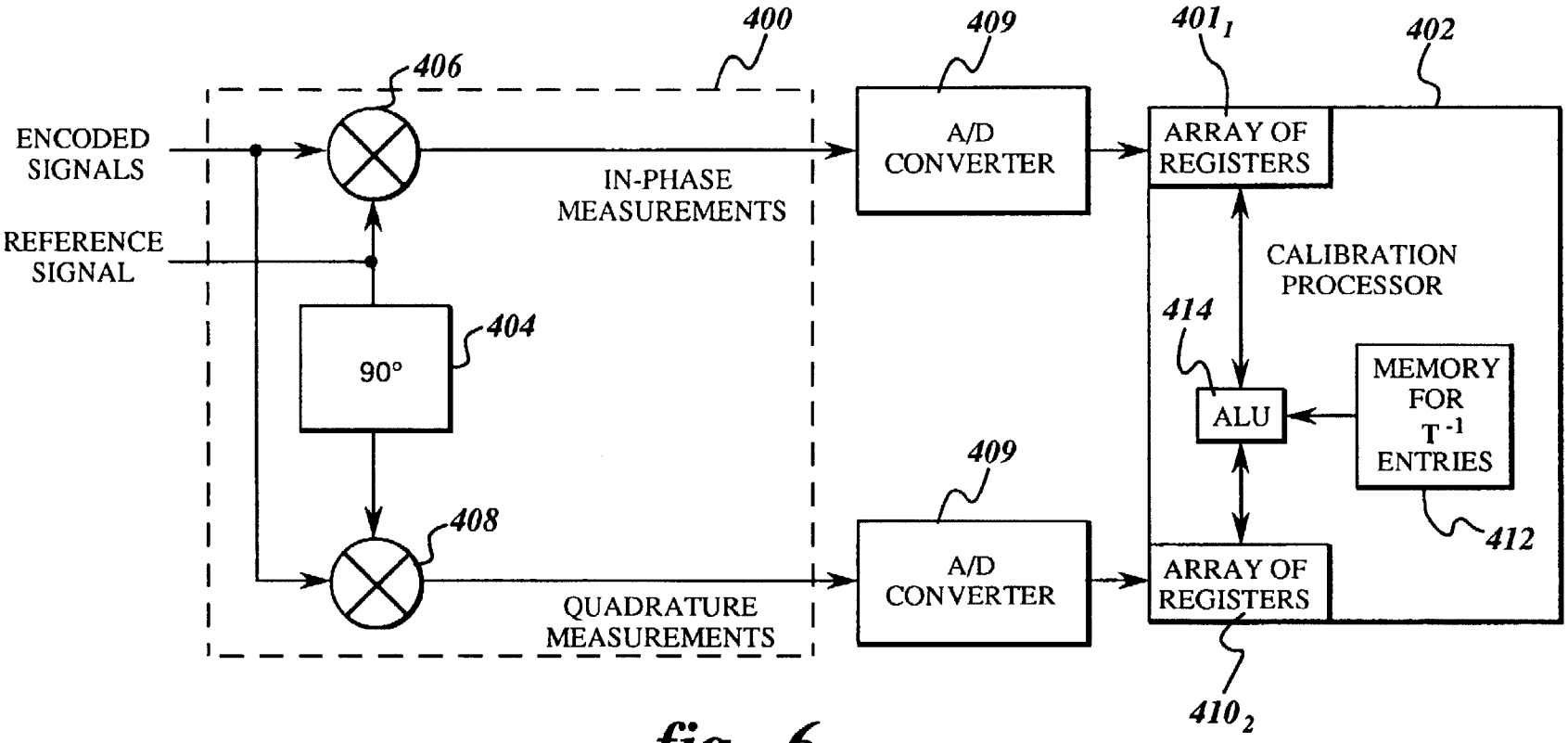
FIG. 6 shows further details about the coherent detector of FIG. 5.

FIG. 6 shows details about coherent detector 400 and calibration processor 402. As shown in FIG. 6, the received reference signal is supplied to a first mixer 406 and to a phase shifter 404, which imparts a phase shift of substantially 90° to the received coherent reference signal. As further shown in FIG. 6, each encoded signal is supplied to first and second mixers 406 and 408, respectively. First mixer 406 mixes any received encoded signal with the reference signal to supply a first mixer output signal replicating the respective component of any received encoded signal that is in phase with the reference signal. Conversely, second mixer 408 mixes any received encoded signal with the phase shifted reference signal to supply a second mixer output signal replicating the respective component of any received encoded signal that is in quadrature (at 90°) with the reference signal. The in-phase and quadrature components are converted to digital data by respective analog-to-digital (A/D) converters 409. As shown in FIG. 6, calibration processor 402 can include register arrays $\mathbf{410}_1$ and $\mathbf{410}_2$ for storing, respectively, the in-phase components and the quadrature components supplied by A/D converters 409. Calibration processor 402 can further include a memory 412 that can store entries for the inverse matrix $T^{-1}$ which is used for decoding the respective quadrature components of the encoded signals. Calibration processor 402 further includes an arithmetic logic unit (ALU) 412 for performing any suitable computations used for decoding the respective quadrature components of the encoded signals. For example, ALU 412 can be used for computing a difference between each quadrature component for the first and second sets of encoded signal, and computing the product of the resulting difference with the inverse matrix $T^{-1}$.

Figure 7:
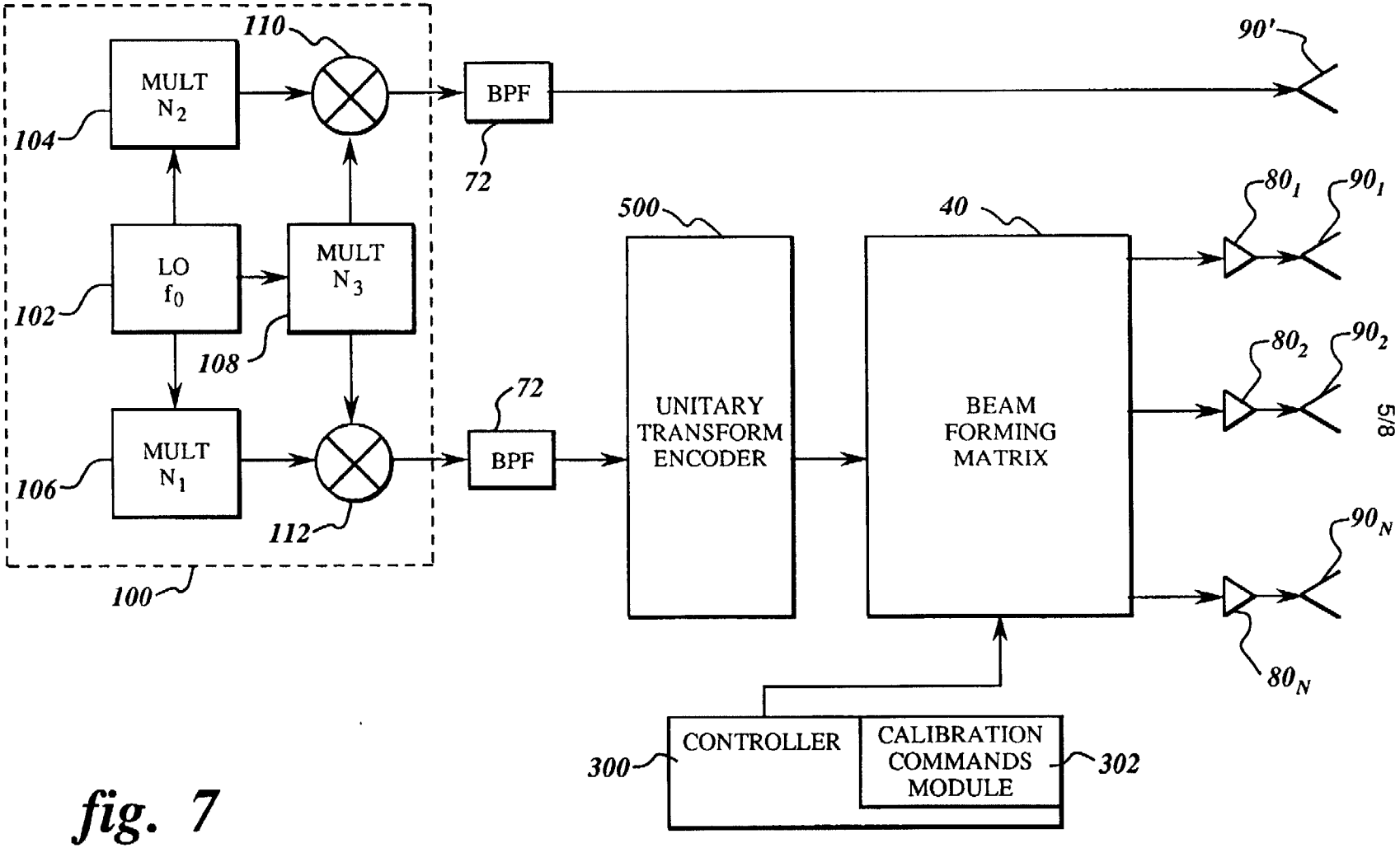
FIG. 7 is a block diagram representation showing an exemplary architecture for the phased array system of FIG. 1, and including a coherent signal generator and a unitary transform encoding in accordance with one preferred embodiment for the present invention.

As described in concurrently-filed U.S. patent application Serial No. 08/499,528, filed Jul. 7, 1995, now U.S. Pat. No. 5,572,219, issued Nov. 5, 1996, entitled "A Method For Remotely Calibrating A Phased Array System Used For Satellite Communication", which is assigned to the same assignee of the present invention and is herein incorporated by reference, one preferred embodiment for performing the encoding of the calibration signal applied to each element of the phased array is to use a binary invertible matrix, such as a Hadamard matrix, for controllably switching the delay circuits that make up beam forming matrix 40. As shown in FIG. 7, and in accordance with another preferred embodiment for the present invention, instead of using the delay circuits that make up beam forming matrix 40 for encoding the calibration signal which is applied to each element of the phased array, in this another preferred embodiment a unitary transform encoder 500 is provided for encoding the calibration signal which is applied to each element of the phased array. By way of example and not of limitation, unitary transform encoder 500 can readily include a suitable memory module (not shown) for storing entries of a predetermined unitary transform matrix, such as a two-dimensional discrete Fourier transform, a Hadamard unitary transform matrix and the like. The reader is referred to textbook entitled "Digital Signal Processing" by A. V. Oppenheim and R. W. Schafer, at 115–120, (1975), available from Prentice Hall Inc., for a detailed treatment of two-dimensional discrete Fourier transforms.

Figure 8:
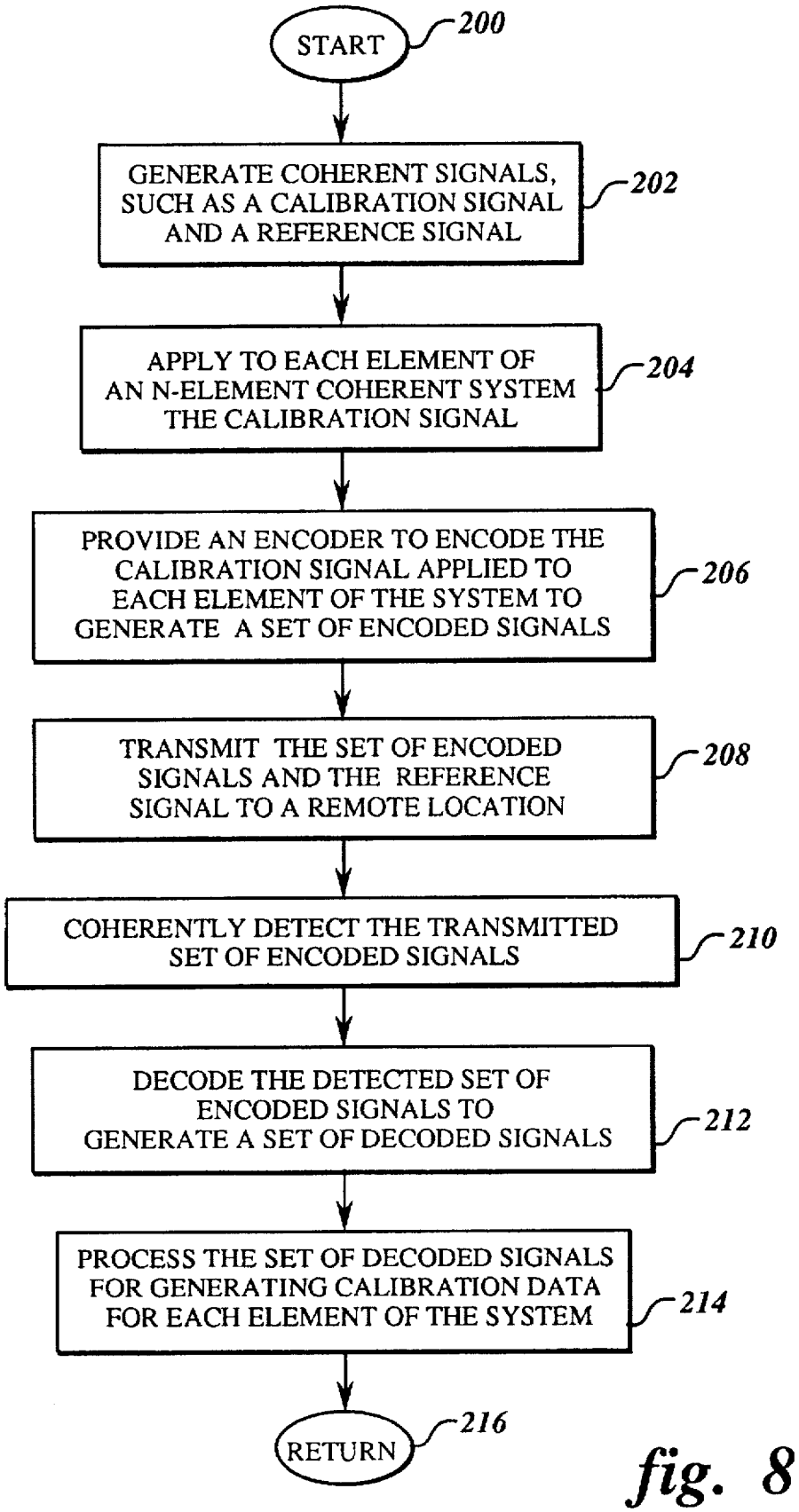
FIG. 8 is a flowchart of an exemplary embodiment for a calibration method in accordance with the present invention.

FIG. 8 shows a flow chart for an exemplary calibration method in accordance with the present invention. After start of operations in step 200, step 204 allows for generating coherent signals, such as the calibration signal and reference signal generated by coherent signal generator 100 (FIGS. 2 and 4). In accordance with step 204, the calibration signal is applied to each element of an N-element coherent system, such as the phased array system of FIG. 2. Step 206 allows for providing an encoder, such as unitary transform encoder 500 (FIG. 7), to encode the calibration signal applied to each element of the coherent system to generate a set of encoded signals. Step 208 allows for transmitting the set of encoded signals and the reference signal to a remote location, such as control station 18 (FIG. 1). Step 210 allows for coherently detecting the transmitted set of encoded signals at the remote location. Step 212 allows for decoding the detected set of encoded signals to generate a set of decoded signals which can be conveniently processed in step 214, prior to end of operations in step 216, for generating calibration data for each element of the phased array system.

Figure 9:
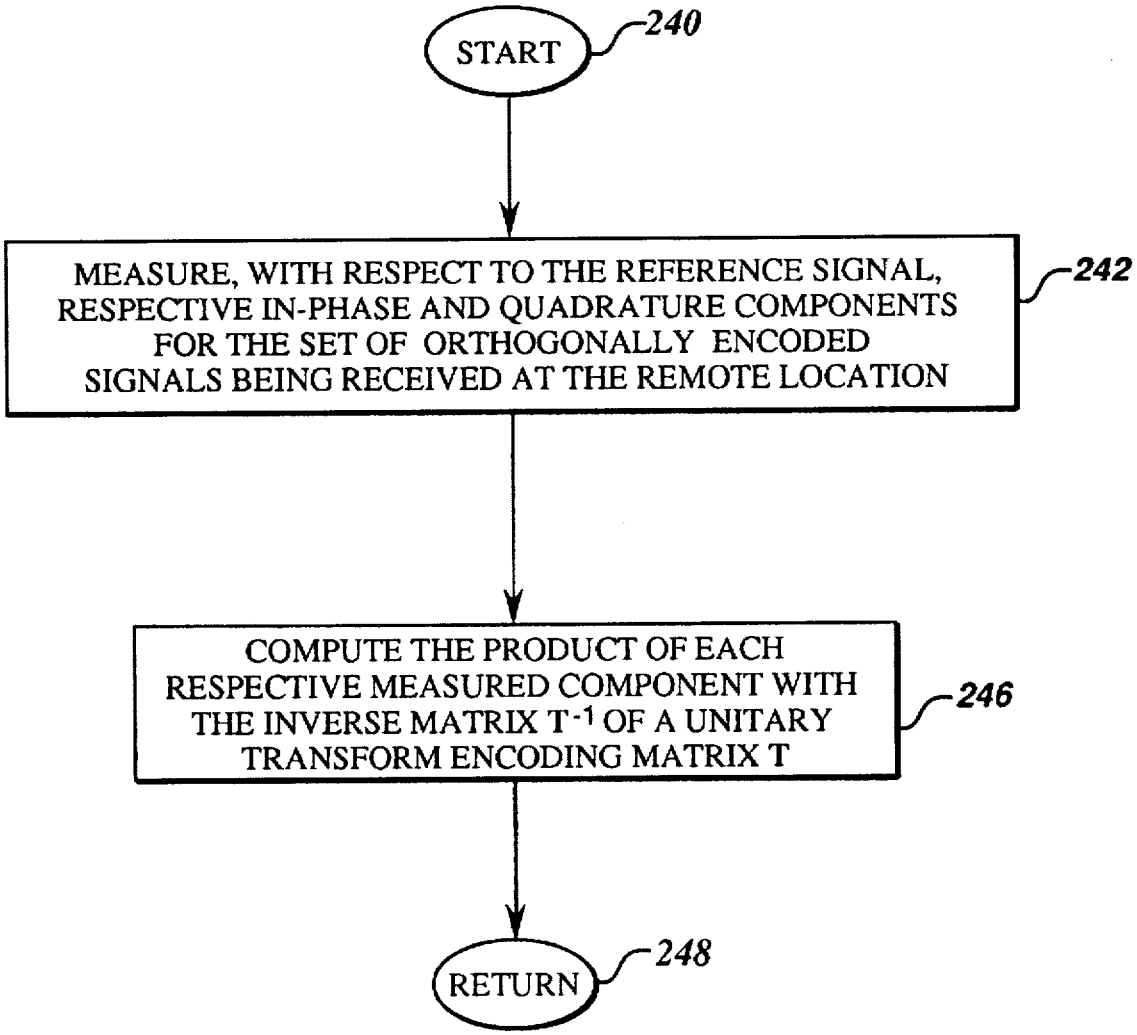
FIG. 9 is a flowchart showing steps used for measuring in-phase and quadrature components of orthogonally encoded signals and for decoding the measured in-phase and quadrature components of the orthogonally encoded signals.

FIG. 9 shows a flowchart that can be used for performing, respectively, detecting step 210 and decoding step 212 (FIG. 8). After start of operations in step 240 and assuming that the set of encoded signals is made up of a set of orthogonally encoded signals, step 242 allows for measuring, with respect to the reference signal, respective in-phase and quadrature components for the set of orthogonally encoded signals which is received at the remote location. For example, coherent detector 400 (FIG. 6) allows for measuring both in-phase and quadrature components of any received encoded signals. This can further include measuring, with respect to the reference signal, the phase and amplitude for the set of orthogonally encoded signals which is received at the remote location since the respective in-phase and quadrature components represent phasor measurements that allow for determining the amplitude and phase of the encoded signals. As will be appreciated by those skilled in the art, a phasor can be conceptualized as a rotating line that represents a sinusoidally varying signal where, for example, the length of the line represents the magnitude of the signal and the angle of the line with a predetermined reference axis represents the phase of the signal. It will be appreciated that absolute measurements are not important since the calibration data can be effectively obtained from relative measurements of phase and amplitude, i.e., respective measurements of variation over time of phase and amplitude for each received encoded signal relative to the phase of the reference signal. As used herein quadrature components refer to components that are a quarter cycle (90°) out-of-phase relative to the in-phase components. Prior to end of operations in step 248, step 246 allows for computing the product of each respective measured component with the inverse of the same unitary transform matrix T, used in the unitary transform encoder. In accordance with another advantage of the present invention, it will be appreciated that the computation of inverse matrix $T^{-1}$ is straightforward since the inverse matrix in this case is simply the Hermitian conjugate-transpose of matrix T normalized by the factor $1/N$.

Figure 10:
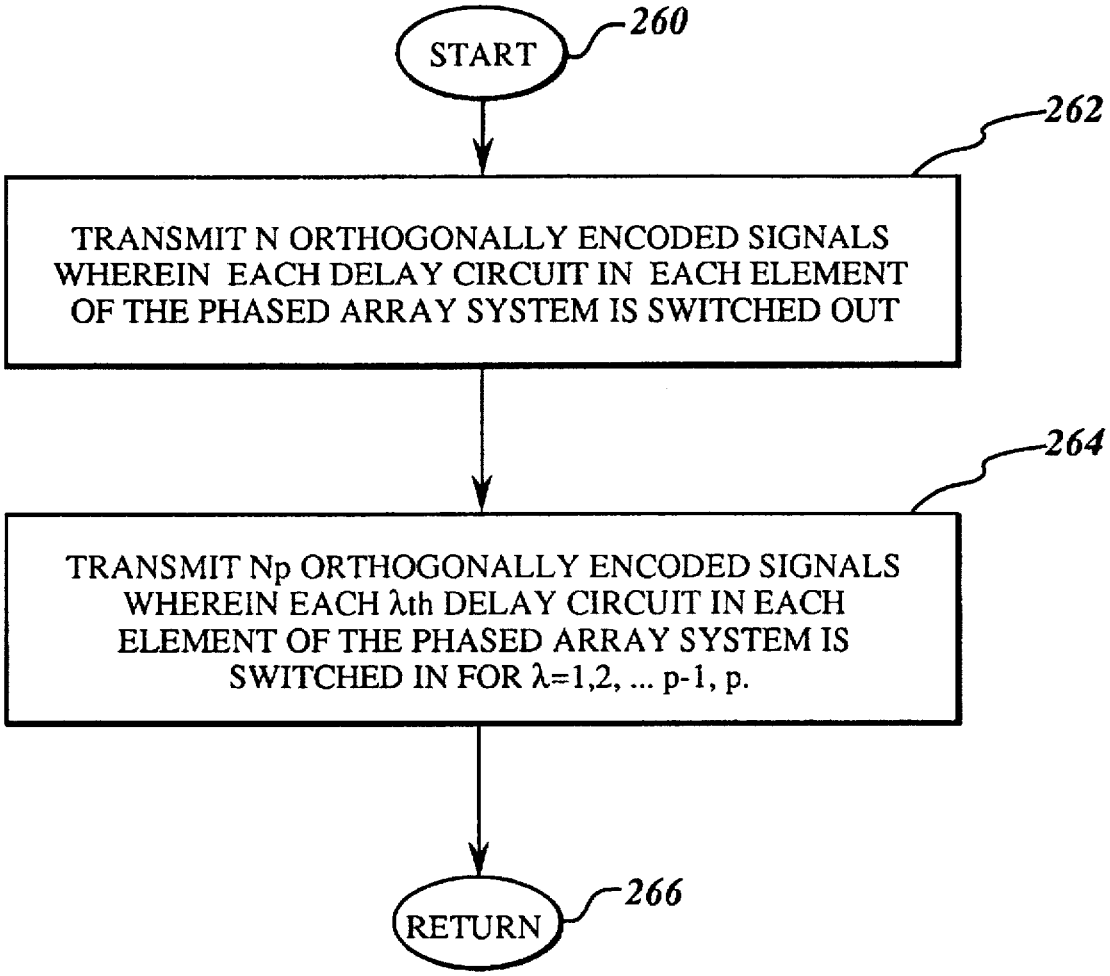
FIG. 10 is a flowchart showing steps for sequentially transmitting the orthogonally encoded signals used for calibrating the phased array system of FIG. 2.

FIG. 10 shows a flowchart which provides further details about transmitting step 208 (FIG. 7) which allows for calibrating the full set of N(p+1) state variables associated with, for example, the N elements for the phased array system of FIG. 2. It will be shown that the calibration procedure in accordance with the present invention generally requires a total of N(p+1) transmissions of encoded signals, such as orthogonally encoded signals. This advantageously enables the calibration procedure in accordance with the present invention to provide information comparable to a SE calibration measurement at a signal-to-noise ratio (SNR) effectively enhanced by a factor N over the SE calibration measurement with the same maximum elemental signal power for each transmission.

After start of operations in step 260, step 262 allows for transmitting N orthogonally encoded signals wherein each delay circuit in each element of the phased array system is switched-out. For this case, each received transmission is conveniently expressed in vector form as, $$Y_0=TS=[y_0(1),y_0(2),\ldots,y_0(N)]^T. \quad (5)$$

Any mth received transmission of the set of orthogonally encoded signals when each delay circuit is switched-out is represented by, $$y_0(m) = \sum_{n=1}^{N} t(mn)s(n). \tag{6}$$

Step 264 allows for transmitting Np transmissions of orthogonally encoded signals wherein each λth delay circuit in each of the elements of the phased array is sequentially switched-in for λ=1, 2, . . . p−1, p. For this case, each received transmission is conveniently expressed in vector form as, $$Y_\lambda = TS_\lambda = [y_\lambda(1), y_\lambda(2), \ldots, y_\lambda(N)]^t. \tag{5}$$

Similarly, any mth received transmission of the set of orthogonally encoded signals is represented by, $$y_\lambda(m) = \sum_{n=1}^{N} t(mn)d_\lambda(n)s(n). \tag{6}$$

The decoded set of signals is obtained by computing the respective product of signal vectors $Y_0$ and $Y_\lambda$ by the inverse, $T^{-}$, of the same unitary transform matrix T that was used in unitary transform encoder 500 (FIG. 7) onboard the satellite for encoding the calibration signal applied to each element of the phased array system. In the absence of noise, $$S = T^{-1}Y_0,\ S_\lambda = T^{-1}Y_\lambda = d_\lambda S \tag{7}$$

The notation, $$S_\lambda = d_\lambda S = \equiv [d_\lambda(1)s(1), d_\lambda(2)s(2), \ldots d_\lambda(N)s(N)]^T, \tag{8}$$

is used to represent the received encoded signal vector when the λth delay circuit is switched-in in each element of the phased array system. Here $d_\lambda = \mathrm{diag}[d_\lambda(1), d_\lambda(2), \ldots d_\lambda(N)]^T$, is a diagonal matrix associated with the complex gains of the λth delay circuit for each element of the phased array system. The components of vector signal S make up the desired straight-through signals while the N complex gains, $\{d_\lambda(n)\}$ are readily computed by taking the ratio of the decoded vector signal components, $$\{d_\lambda(n)\} = \left\{ \frac{d_\lambda(n)s(n)}{s(n)} \right\} \tag{9}$$

By way of example and not of limitation of the above-described calibration technique, the procedural steps for computing calibration data of p delay circuits and the straight-through signals for a four-element phased array system will now be illustrated using the natural form of a 4th order Hadamard matrix as the renormalized unitary (orthogonal) transformation matrix, $$H_{Nat} = \begin{bmatrix} +1 & +1 & +1 & +1 \\ +1 & -1 & +1 & -1 \\ +1 & +1 & -1 & -1 \\ +1 & -1 & -1 & +1 \end{bmatrix} \tag{10}$$

The coding of the straight-through signals with no delay circuit being switched-in is indicated by Eq. (5), which in this case becomes $$HS \xrightarrow{\text{at control station}} Y_0,$$

$$\begin{bmatrix} +1 & +1 & +1 & +1 \\ +1 & -1 & +1 & -1 \\ +1 & +1 & -1 & -1 \\ +1 & -1 & -1 & +1 \end{bmatrix} \begin{bmatrix} s(1) \\ s(2) \\ s(3) \\ s(4) \end{bmatrix} \xrightarrow{\text{at control station}} \begin{bmatrix} y_0(1) \\ y_0(2) \\ y_0(3) \\ y_0(4) \end{bmatrix}.$$

Again the zero subscript on signal vector $Y_0$ refers to the following straight through encoded signals:

$$y_0(1) = [s(1) + s(2) + s(3) + s(4)] \xrightarrow{\text{1st coded trans. burst}}; \tag{12}$$

$$y_0(2) = [s(1) - s(2) + s(3) - s(4)] \xrightarrow{\text{2nd coded trans. burst}};$$

$$y_0(3) = [s(1) + s(2) - s(3) - s(4)] \xrightarrow{\text{3rd coded trans. burst}};$$

$$y_0(4) = [s(1) - s(2) - s(3) + s(4)] \xrightarrow{\text{4th coded trans. burst}}.$$

The transmission of orthogonally encoded signals is sequentially repeated with a predetermined delay circuit, such as the λth delay circuit being sequentially switched in on all the elements of the phased array system. For λ=1, 2, . . . p−1, p, the encoded signals $Y_\lambda = Td_\lambda S$ received at the control station are, $$y_\lambda(1) = \tag{13}$$

$$[d_\lambda(1)s(1) + d_\lambda(2)s(2) + d_\lambda(3)s(3) + d_\lambda(4)s(4)] \xrightarrow{\text{1st coded trans. burst}};$$

$$y_\lambda(2) =$$

$$[d_\lambda(1)s(1) - d_\lambda(2)s(2) + d_\lambda(3)s(3) - d_\lambda(4)s(4)] \xrightarrow{\text{2nd coded trans. burst}};$$

$$y_\lambda(3) =$$

$$[d_\lambda(1)s(1) + d_\lambda(2)s(2) - d_\lambda(3)s(3) - d_\lambda(4)s(4)] \xrightarrow{\text{3rd coded trans. burst}};$$

$$y_\lambda(4) =$$

$$[d_\lambda(1)s(1) - d_\lambda(2)s(2) - d_\lambda(3)s(3) + d_\lambda(4)s(4)] \xrightarrow{\text{4th coded trans. burst}}.$$

The received encoded signals are decoded at the control station with the inverse of the encoding transform matrix as shown by Eq. (7), which in this case is simply the inverse of the exemplary 4th order Hadamard matrix illustrated in Eq. (10).

While only certain features of the invention have been illustrated and described herein, many modifications, substitutions, changes, and equivalents will now occur to those skilled in the art. For example, although the above-described example illustrates use of Hadamard matrixes in their "natural form", it will be understood that the encoding can be performed using all forms of Hadamard matrixes and thus the present invention is not limited to "natural form" Hadamard matrixes. It is, therefore, to be understood that the appended claims are intended to cover all such modifications and changes as fall within the true spirit of the invention.

What is claimed is:

1. A method for remotely calibrating a system having a plurality of N elements, N being a positive integer number, said method comprising the steps of;

coherently generating a calibration signal and a reference signal having a predetermined spectral relationship between one another;

applying to each respective one of said plurality of N elements the calibration signal;

providing an encoder for encoding the calibration signal applied to each respective one of said plurality of N elements to generate a set of encoded signals, said encoder comprising a unitary transform encoder based upon entries of a predetermined unitary transform matrix T;

transmitting the set of encoded signals and the reference signal to a remote location;

coherently detecting the transmitted set of encoded signals at the remote location;

decoding the coherently detected set of encoded signals to generate a set of decoded signals; and processing the set of decoded signals for generating calibration data for each element of said system.

2. The method of claim 1 wherein said system comprises a phased array system and each of said N elements in said phased array system includes a plurality of p delay circuits.

3. The method of claim 1 wherein said predetermined unitary transform matrix T comprises a unitary transform matrix selected from the group consisting of Hadamard and two-dimensional discrete Fourier transform matrixes.

4. The method of claim 1 wherein said unitary transform matrix T comprises a matrix having at least a size N×N.

5. The method of claim 4 wherein said binary matrix comprises a Hadamard matrix.

6. The method of claim 1 wherein the set of encoded signals generated by said unitary transform encoder comprises a set of orthogonally encoded signals.

7. The method of claim 6 wherein said coherently detecting step comprises measuring, with respect to said reference signal, respective in-phase and quadrature components for the set of orthogonally encoded signals being received at the remote location.

8. The method of claim 6 wherein said decoding step comprises:

computing the product of each respective measured in-phase and quadrature components with the inverse matrix $T^{-1}$ of matrix T.

9. The method of claim 7 wherein said measuring step comprises measuring, with respect to said reference signal, phase and amplitude of the set of orthogonally encoded signals being received at the remote location.

10. The method of claim 1 wherein said transmitting step comprises transmitting a total of N(p+1) transmissions of orthogonally encoded signals.

11. The method of claim 10 wherein N of the total of N(p+1) transmissions of orthogonally encoded signals comprise respective transmissions of orthogonally encoded signals wherein each delay circuit in each element of the phased array system is switched-out.

12. The method of claim 10 wherein Np of the total of N(p+1) transmissions of orthogonally encoded signals comprise respective transmissions of orthogonally encoded signals wherein a λth delay circuit in each element of the phased array system is sequentially switched-in for λ=1, 2, . . . p−1, p.

13. Apparatus for remotely calibrating a system having a plurality of N elements, N being a positive integer number, said apparatus comprising:

a coherent signal generator for generating a calibration signal and a reference signal having a predetermined spectral relationship between one another;

means for applying to each respective one of said plurality of N elements the calibration signal;

an encoder for encoding the calibration signal applied to each respective one of said plurality of N elements to generate a set of encoded signals, said encoder comprising a unitary transform encoder based upon entries of a predetermined unitary transform matrix T;

means for transmitting the set of encoded signals and the reference signal to a remote location;

a coherent detector for detecting the transmitted set of encoded signals at the remote location;

means for decoding the coherently detected set of encoded signals to generate a set of decoded signals; and a signal processor for processing the set of decoded signals for generating calibration data for each element of said system.

14. The apparatus of claim 13 wherein said system comprises a phased array system and each of said N elements in said phased array system includes a plurality of p delay circuits.

15. The apparatus of claim 13 wherein said predetermined unitary transform matrix T comprises a unitary transform matrix selected from the group consisting of Hadamard and two-dimensional discrete Fourier transform matrixes.

16. The apparatus of claim 13 wherein said unitary transform matrix T comprises a binary matrix having at least a size N×N.

17. The apparatus of claim 16 wherein said binary matrix comprises a Hadamard matrix.

18. The apparatus of claim 13 wherein the set of encoded signals generated by said unitary transform encoder comprises a set of orthogonally encoded signals.

19. The apparatus of claim 18 wherein said coherent detector comprises means for measuring, with respect to said reference signal, respective in-phase and quadrature components for the set of orthogonally encoded signals being received at the remote location.

20. The apparatus of claim 18 wherein said means for decoding comprises:

means for computing the product of each respective measured in-phase and quadrature components with the inverse matrix $T^{-1}$ of matrix T.

21. The apparatus of claim 19 wherein said means for measuring respective in-phase and quadrature components for the set of orthogonally encoded signals comprises means for measuring, with respect to said reference signal, phase and amplitude of the set of orthogonally encoded signals being received at the remote location.

22. The apparatus of claim 18 wherein said means for transmitting in operation transmits a total of N(p+1) transmissions of orthogonally encoded signals.

23. The apparatus of claim 22 wherein N of the total of N(p+1) transmissions of orthogonally encoded signals comprise respective transmissions of orthogonally encoded signals wherein each delay circuit in each element of the phased array system is switched-out.

24. The apparatus of claim 22 wherein Np of the total of N(p+1) transmissions of orthogonally encoded signals comprise respective transmissions of orthogonally encoded signals wherein a λth delay circuit in each element of the phased array system is sequentially switched-in for λ=1, 2, . . . p−1, p.

* * * * *